US005193677A

United States Patent [19]

Moreno

[11] Patent Number: 5,193,677

[45] Date of Patent: Mar. 16, 1993

[54] SURFBOARD STORAGE AND CARRYING BAG WITH PNEUMATIC INFLATED GUARD RAIL

[76] Inventor: Richard Moreno, 21661 Brookhurst, #330, Huntington Beach, Calif. 92646

[21] Appl. No.: 813,790

[22] Filed: Dec. 27, 1991

[51] Int. Cl.[5] ..... B65D 85/00; B65D 81/02; B65D 65/02

[52] U.S. Cl. ..... 206/315.1; 206/522; 150/154

[58] Field of Search ..... 206/315.1, 522; 150/154

[56] References Cited

U.S. PATENT DOCUMENTS

| | | | |
|---|---|---|---|
| 3,339,607 | 9/1967 | Howard | 206/315.1 |
| 4,402,355 | 9/1983 | Wymore et al. | 206/315.1 |
| 4,483,380 | 11/1984 | Beran | 206/315.1 |
| 4,574,953 | 3/1986 | Garbuzov | 206/522 |
| 5,033,497 | 7/1991 | Hernandez | 206/315.1 |
| 5,094,344 | 3/1992 | Savage | 206/315.1 |

*Primary Examiner*—William I. Price
*Attorney, Agent, or Firm*—Beech & Collins

[57] ABSTRACT

An improved surfboard storage and carrying bag with a pneumatically inflated guard rail comprising of three circumferential tubes on each pneumatically inflated and attached inside a surfboard storage or carrying bag that when inflated provides a guard rail or bumper to prevent sharp blows from chipping or denting the edge of the surfboard stored inside. An inflatable pillow that protects fin protrusions for a surfboard is also described.

6 Claims, 1 Drawing Sheet

SURFBOARD STORAGE AND CARRYING BAG WITH PNEUMATIC INFLATED GUARD RAIL

FIELD OF INVENTION

The instant invention relates to improved surfboard storage and carrying bags.

DESCRIPTION OF PRIOR ART

Inventions and ideas similar to the improved surfboard storage and carrying bag are primarily directed towards the entire surface of the surfboard but are not directed to providing adequate protection to prevent dents or chipping of the surfboard edge or in the fin area when the surfboard includes fins. The surfboard edge surfaces and fin protrusions are, as expected, especially vulnerable to damage.

SUMMARY OF THE INVENTION

The instant invention provides a convenient storage and carrying bag having a guard rail that when pressurized provides substantially improved protection to the surfboard edge. The increased protection prevents chipping and denting the surfboard when being stored or transported. The pressurized guard rail is part of a bag that encloses the entire surfboard. The guard rail includes a set of pneumatically inflated tubes along the outer perimeter of the bag that fits snugly above, below and on the edges of the surfboard. In one embodiment, a pressurized pillow fits between the fins and may extend beyond the fins. In accordance with the description presented herein, other objects of the invention will become apparent when the drawings and specifications herein are reviewed.

DESCRIPTION OF THE PREFERRED EMBODIMENT

Figure 1:
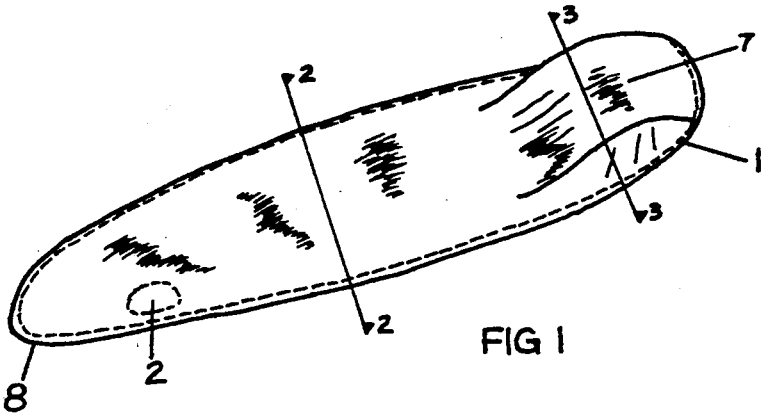
FIG. 1 is an isometric view of the bottom of the surfboard storage and carrying bag
Figure 2:
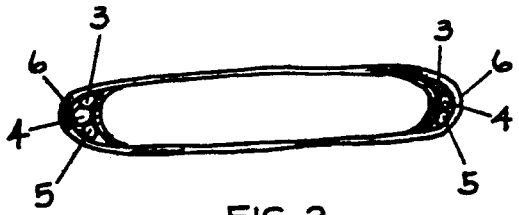
FIG. 2 is a cross section view of the surfboard storage and carrying bag in the mid area.
Figure 3:
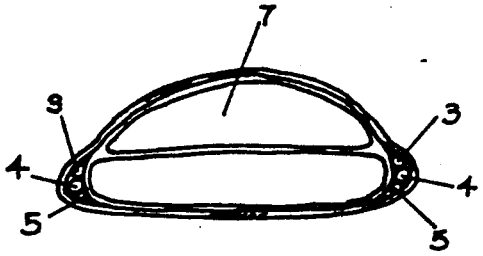
FIG. 3 is a cross section view of the surfboard storage and carrying bag across the fin area.
Figure 4:
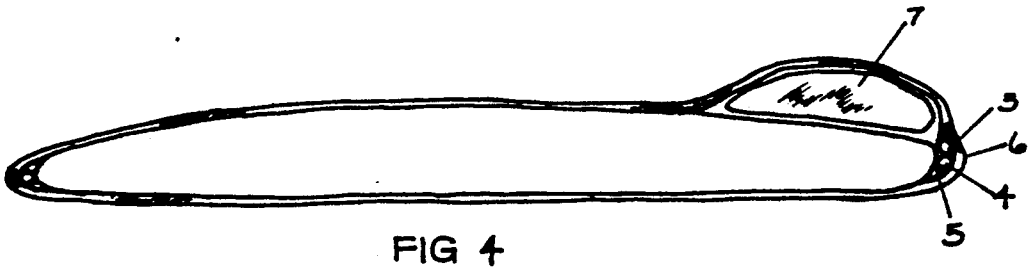
FIG. 4 is a cross section view of the surfboard storage and carrying bag along the length of the assembly.
Figure 5:
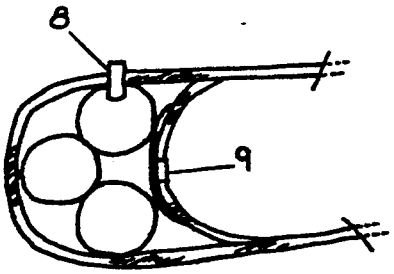
FIG. 5 illustrates a detailed cross section of the side construction of the device.

Referring to FIGS. 1 through 5, the improved surfboard storage and carrying bag is illustrated. The bag (1) itself may be made in any manner. The bag (1) is of a size to cover a surfboard or similar device. The preferred embodiment is covered with a durable soft water proof material that is easily washable and does not easily stain. A heavy material should be used for best cushioning. Attached to the interior portion of the bag (1) are three tubes, an upper tube (3), a middle tube (4) and a lower tube (5). The upper tube (3) is attached or held in position at a plurality of points to the middle tube (4). The lower tube (5) is also attached at a plurality of points to the middle tube (4). As shown, a zipper (9) is attached to the inside of the perimeter of the bag. A flap of material (6) protects the tubes from the zipper (9).

The length of upper tube (3) and lower tube (5) are slightly smaller than the perimeter of the surfboard. The middle tube (4) is the same length as the perimeter of the surfboard. When inflated, the tubes expand and become ridged forming a protective guard rail. A hand pump (2) is provided at any convenient location within the bag to allow easy inflation of the tubes. A release valve (8) is provided to collapse the bag when not in use.

On the bottom of the surfboard and carrying bag an inflatable pillow (7) is attached to the bag (1). The inflatable pillow (7) is of sufficient size to fit snugly between the fins or over the fins depending on the fin confinements.

I claim:

1. An improved surfboard storage bag that comprises:
   a. a bag that encloses a surfboard that is composed of two halves that are similar in shape to the surfboard and are attached to each other by an attachment means that attaches each half to the interior perimeter of each side of the bag.
   b. three tubes capable of being inflated and able to maintain the interior pressure once inflated comprising one middle tube of sufficient length to fit circumferentially around the outer edge of the surfboard, one upper tube attached to the middle and a lower tube attached to the middle tubes each of a length that is shorter than the middle tube.
   c. a means to allow inflating and deflating of the tubes.

2. An improved surfboard storage and carrying bag as in claim 1 wherein the attachment means for the two halves is a zipper mechanism.

3. An improved surfboard storage and carrying bag as in claim 1 wherein a strip of material is attached along the attachment means to cover and protect the upper, middle, and lower tubes from the attachment means.

4. An improved surfboard storage bag that comprises:
   a. a bag that enclosed a surfboard that is composed of two halves that are similar in shape to the surfboard and are attached to each other by an attachment means that attaches each half to the interior perimeter of each side of the bag.
   b. three tubes capable of being inflated and able to maintain the interior pressure once inflated comprising one middle tube of sufficient length to fit circumferentially around the outer edge of the surfboard, one upper tube attached to the middle tube and a lower tube attached to the middle tube each of a length that is shorter than the middle tube.
   c. an inflatable pillow and an inflatable pillow attachment means that attaches the inflatable pillow to the inside of the bag in a manner to protect fin protrusions from the surfboard being carried.
   d. a means to allow inflating and deflating of the tubes.

5. An improved surfboard storage and carrying bag as in claim 4 wherein the attachment means for the two halves is a zipper mechanism.

6. An improved surfboard storage and carrying bag as in claim 4 wherein a strip of material is attached along the attachment means to cover and protect the upper, middle, and lower tubes from the attachment means.

* * * * *